US005594422A

United States Patent [19]

Huey, Jr. et al.

[11] Patent Number: 5,594,422

[45] Date of Patent: Jan. 14, 1997

[54] UNIVERSALLY ACCESSIBLE SMOKE DETECTOR

[75] Inventors: Richard W. Huey, Jr.; Neil D. Lerner, both of Silver Spring, Md.; David B. Chaney; Joseph A. Koncelik, both of Westerville, Ohio

[73] Assignee: COMSIS Corporation, Silver Spring, Md.

[21] Appl. No.: 246,094

[22] Filed: May 19, 1994

[51] Int. Cl.[6] ..... G08B 17/00

[52] U.S. Cl. ..... 340/628; 340/629; 340/630; 340/693; 340/539

[58] Field of Search ..... 340/628, 630, 340/539, 629, 693

[56] References Cited

U.S. PATENT DOCUMENTS

| | | | |
|---|---|---|---|
| 3,713,491 | 1/1973 | Grabowski et al. | 169/2 R |
| 4,030,086 | 6/1977 | Salem | 340/249 |
| 4,160,246 | 7/1979 | Martin | 340/539 |
| 4,228,428 | 10/1980 | Niedermeyer | 340/628 |
| 4,305,069 | 12/1981 | Machen et al. | 340/628 |
| 4,517,555 | 5/1985 | Marsocci et al. | 340/628 |
| 4,550,312 | 10/1985 | Galloway et al. | 340/539 |
| 4,617,561 | 10/1986 | Brown | 340/628 |
| 4,737,769 | 4/1988 | Masot | 340/533 |
| 4,808,977 | 2/1989 | Hedrick | 340/691 |
| 4,833,458 | 5/1989 | Bowman | 340/628 |
| 4,916,432 | 4/1990 | Tice et al. | 340/511 |
| 4,968,975 | 11/1990 | Fritz | 340/628 |
| 5,012,223 | 4/1991 | Griebell et al. | 340/531 |
| 5,052,752 | 10/1991 | Epstein et al. | 340/628 |
| 5,289,165 | 2/1994 | Belin | 340/628 |

*Primary Examiner*—John K. Peng
*Assistant Examiner*—Julie B. Lieu
*Attorney, Agent, or Firm*—James Creighton Wray

[57] ABSTRACT

A wall-mounted stand-alone smoke detector has an elongated housing. The housing has two ends. One end forms a base. The other end houses a sensor head remote from the base. A rigid member supports the sensor and connects the sensor to the base. The sensor head has a smoke sensor, a signal conditioner and a preamplifier for respectively detecting, conditioning, amplifying and providing signals from the sensor to a signal processor in the base. A positioning probe is attached to the sensor head end of the housing for positioning the sensor spaced from a ceiling of a room. The end housing the sensor may be angled for spacing the sensor from a wall on which the detector is mounted. All mounting, display control interaction and routine maintenance can be performed within easy reach, without climbing. The base has a power supply. A signal processor in the base is connected to the sensor head. Circuitry analyzes and processes signals, recognizing an alarm state and activating audible and visual alarms. Displays on the base which are at user eye level provide output of the signal processor. Buttons are provided on the base to test the detector and to cancel alarms. The buttons have distinct visual and tactile indicators to differentiate them from one another. A drop flag attached to the base communicates with the sensor and persistently indicates the reduced power supply status within the detector. Several such smoke detector units (DU) are combinable with a remote output unit (ROU) communicating with the detector units.

11 Claims, 7 Drawing Sheets

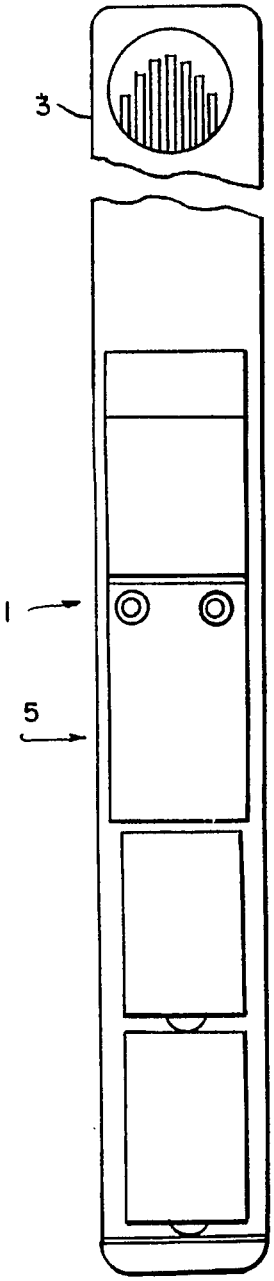
FIG. 1
FIG. 2
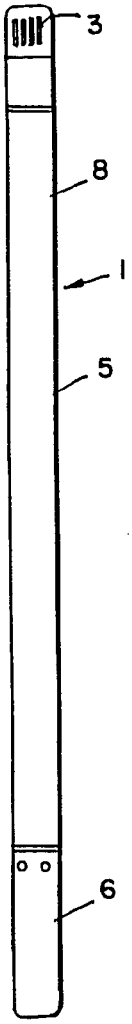
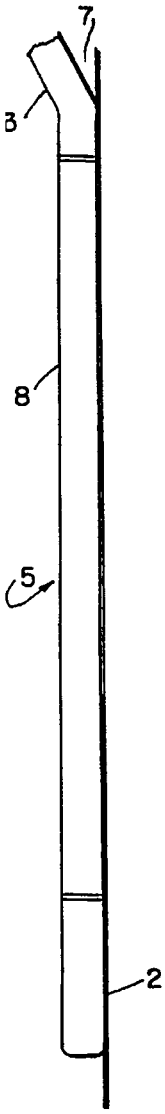
FIG. 3
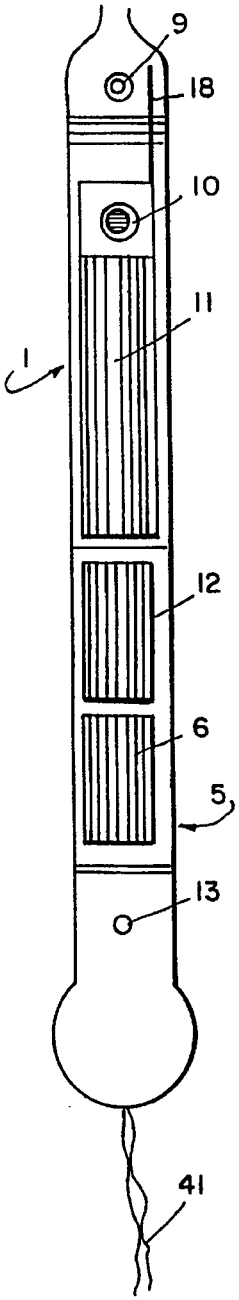
FIG. 4

FIG. 15a
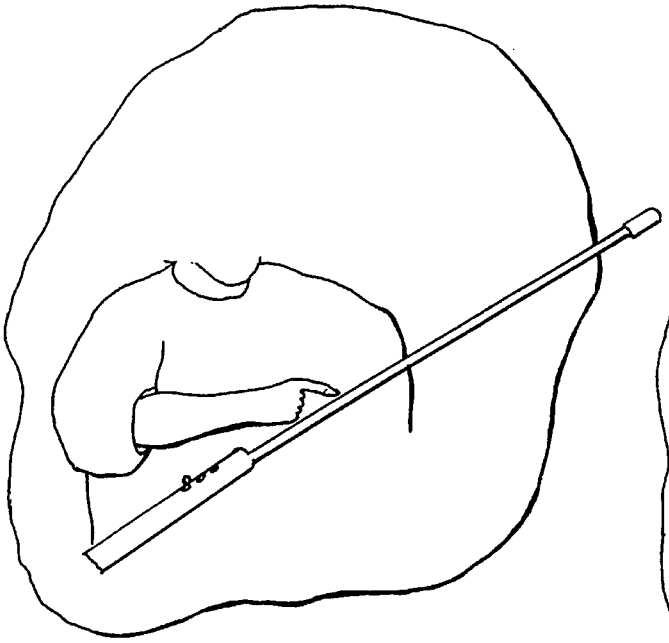
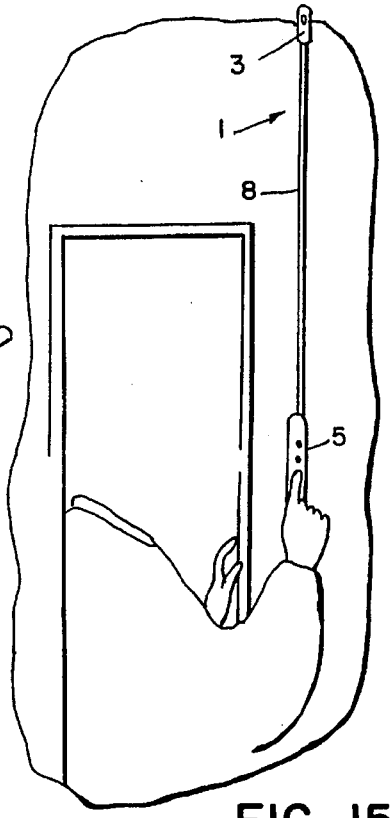
FIG. 15c
FIG. 15b
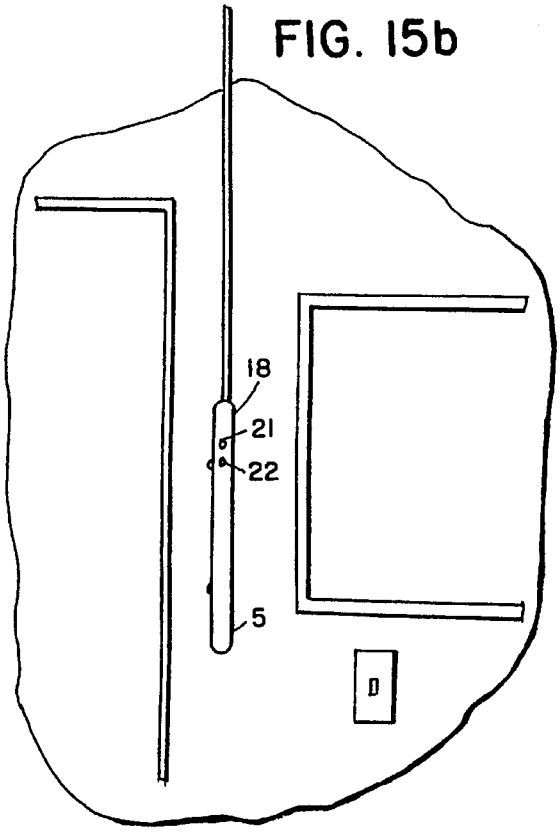
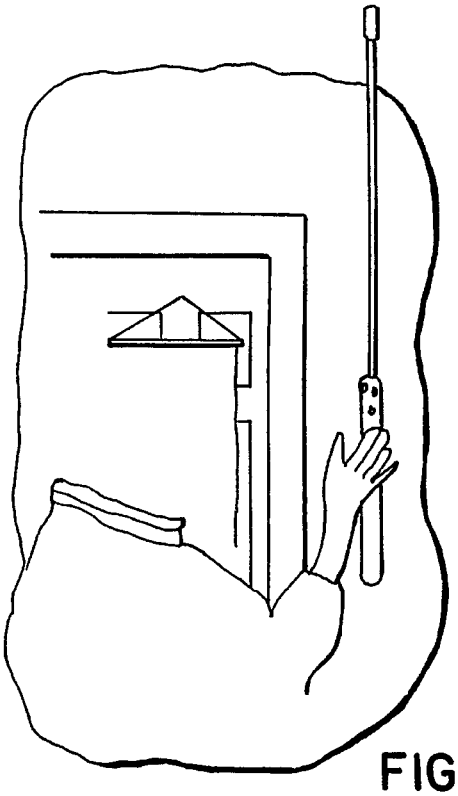
FIG. 15d

Death rates from residential fires by age group, United States, 1978-1984*

*Reproduced from Gulaid, Sattin, and Waxweiler (1988).

UNIVERSALLY ACCESSIBLE SMOKE DETECTOR

BACKGROUND OF THE INVENTION

The present invention relates to smoke detectors which are easily mounted on walls, are universally accessible and provide eye level user interface.

There are numerous smoke detectors on the market that must be mounted on ceilings in order to be effective for smoke detection.

However, a need exists for smoke detectors that are universally accessible and that can provide visual and audible alerts at eye level, precluding the need for high reaches or climbing for installation, maintenance or other interactions.

The graph shown in FIG. 16 indicates that death rates from residential fires increase with age. Older people suffer high residential fire death rates. In private homes, these older residents may be primarily responsible for installing and maintaining fire safety equipment.

Prior art products do not adequately meet the needs of older people. In fact, the products themselves account for safety hazards of their own, since the products call for climbing to ceiling levels in order to install, test and maintain the detectors. But, older people who cannot do those tasks either tend to ignore the needs for installation and for periodic testing and maintenance or have to hire outsiders, thereby incurring high expenses. The grasping and twisting movements required to open and close and install batteries in existing detectors are difficult for older people or people with other physical limitations.

Moreover, the acoustic properties of currently available alarms are not optimal for older people. Signals indicating low battery levels as well as smoke detection are difficult to hear and are not well comprehended by older people who may be suffering from reduced hearing capabilities or mental capacity.

The above problems are also relevant to populations other than the elderly. There is a need for user friendly and cost-effective smoke detectors. It is foreseeable that this device could satisfy the special access requirements of some handicapped or wheelchair-bound individuals, as well.

A need exists for an easily installable and universally accessible smoke detector that has an optimum user interface, that is cost effective and that is not intimidating to the expected users.

SUMMARY OF THE INVENTION

The present invention solves the existing problems by providing a wall-mountable, elongated, universally-accessible smoke detector which can be installed by anyone at user eye levels. Many of the prior art problems are addressed and uniquely solved by the present invention.

In a preferred embodiment, the invention provides a stand-alone, single-station, battery-powered, smoke detector with an elongated housing of approximately two to four feet in length. The detector housing has two ends. The lower end of the housing is wall-mountable at about eye level for easy physical interaction by users, with the upper end of the housing located near the ceiling for most effective detection of smoke accumulations. The two ends of the detector are connected by a rigid member to allow a singular mounting point (i.e., a cantilever) at the base to secure the sensor end of the detector in its proper location, several inches below the ceiling. No further mounting is necessary above the base of the detector. A releasable mounting means is also provided to allow simple removal of the entire unit from the wall for ease of cleaning, battery replacement, and other maintenance needs. A snap-fit connection or the like may be provided to allow extension of the rigid mast for higher ceiling applications or for adding flame or heat detection capability to the detector.

The base is comprised of a mounting means, power supply, control electronics and a user interface having audible and visual output means at about eye level. Logic circuitry for analyzing the system condition and processed signals, recognizing an alarm state and activating audible and visual alarms is located within this portion of the detector. The sound output device may be amplified with the aid of a resonating tube. Such sound amplification would improve sound detection by increasing the sound pressure level without effecting additional requirements on the power supply. A visual battery indicator in the form of an electromechanical drop flag on the base warns the user of a low, dead, or missing battery. This indicator provides a persistent indicator even after battery life has completely expired, unlike most current detectors which rely on periodic LED flashing and audible chirps (battery powered) alone to signal battery imminent battery demise. Visually and tactually distinctive buttons are provided on the base to allow users to test the system and temporarily cancel alarms, even with obscured or impaired vision.

The upper (sensor) end of the detector has a smoke sensor, a signal conditioner, a transmitter, and a preamplifier for respectively detecting, processing, and transmitting amplified signals from the sensor to the signal processor in the base. The sensor of a smoke detector should be ideally located close to or at the ceiling, but away from corners, for maximum exposure to accumulations of smoke. A positioning probe is attached to the upper end of the detector housing to aid in positioning the sensor with respect to the ceilings of rooms. This probe positions the sensor about six inches below the ceiling. The sensor may also be angled outward for spacing the sensor with respect to the wall on which the detector is mounted.

An optional configuration allows multiple such detector units (DU) to be usable with a remote output unit (ROU), powered by household current, a rechargeable battery, or both. In this configuration, the ROU will receive information from one or more detector units within the premises via a radio frequency data link. The ROU is portable and can be relocated easily for providing local annunciation of the smoke detector alert signals near the user's current location in and around the home. This feature is expected to be useful for cases when the user may be hampered from detecting an alarm signal due to separation by distance or barriers, reduced sensitivity during sleep, etc.

A removable egress aid is provided on the ROU for providing a visual alert of the system output (smoke or problems signals), and for removal in emergencies to help the user navigate around darkened and/or smoke-filled places and locate safe exits. This aid will resemble a flashlight. The ROU is provided with necessary charging capability to recharge batteries for transfer to the detector units when DU battery power falls below an acceptable level.

These and further and other objects and features of the invention are apparent in the disclosure, which includes the above and ongoing written specification, with the claims and the drawings.

BRIEF DESCRIPTION OF THE DRAWINGS

FIG. 1 shows a broken, frontal view of one embodiment of the entire smoke detector.

FIG. 2 is a front view of one embodiment of the smoke detector housing.

FIG. 3, is a side view of the detector of FIG. 2 mounted on a wall.

FIG. 4 is a sectional view of another embodiment of the base unit.

FIG. 15*a* shows a user cleaning the dismounted unit.

FIGS. 15*b*, 15*c* and 15*d* show the easy access and installation of the unit by the users.

DETAILED DESCRIPTION OF THE DRAWINGS

Figure 6:
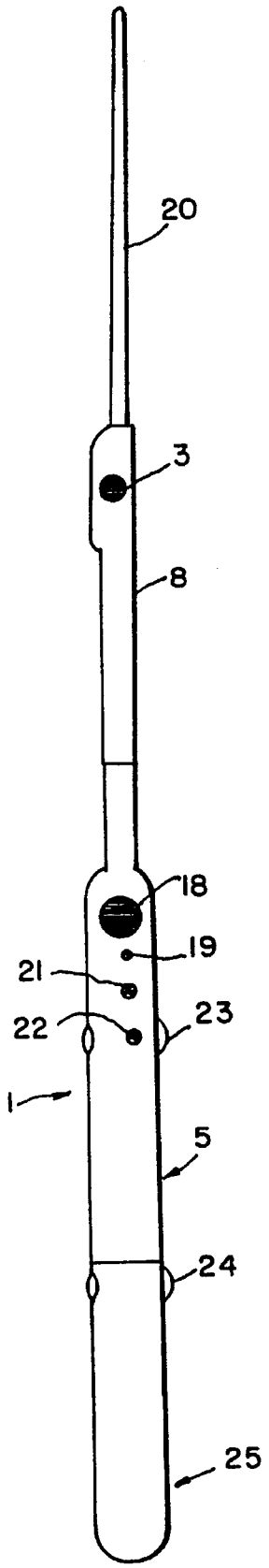
FIG. 6 shows a preferred embodiment of the elongated detector with a telescoping positioning probe in its extended position (not to scale).

The smoke detector of the present invention as shown in FIGS. 1 to 11 is generally referred to by the numeral 1. Like numerals relate to like elements in all the figures. The detector unit shown is preferably a single-station, stand-alone smoke detector 1, which can be upgraded to transmit alarms as well as status signals to remote output units within the house via radio frequency data link. The present system is preferably modular to accommodate an appropriate number of smoke detectors for any residence and to provide remote signalling consistent with the location and activities of a person.

The detector unit is capable of communicating with remote output units when one or more detector units are installed to network with a remote output unit.

FIG. 1 shows a segmented view of the housing of detector 1, forming the base 5 at one end of the housing. In this embodiment, width of the unit is uniform from end to end. An integrally formed rigid member 8 supports the sensor 3 in the housing 1. The lower end of the base houses the battery compartment, as will be further described below.

FIG. 2 shows the same embodiment of the invention as FIG. 1, unsegmented. The base 5 has the battery compartment 6.

Additional rigid separation members may be provided if ceilings are unusually high, so that the sensor can be raised to the requisite level below the ceiling at the same time the base is positioned within appropriate user interface levels. The separation units may be easily snap-fit between the sensor and the base. They may be of differing lengths, such as 2, 4 or 6 feet, according to user needs. The separation units and the rigid member 8 have the same cross-sectional size in this embodiment. Member 8 will be the topmost element (below the sensor) to be fitted on the extended units. The base can have press fit or snap connected or permanently joined control and power supply sections. The support member 8 supporting the sensor 3 can be attached to the base either telescopically or by press fit or by any other mode of attachment.

FIG. 3 shows the detector mounted on a wall 2 with the sensor portion 3 being angled at 7, thereby spacing the sensor from the wall 2.

FIG. 4 is a view of the base portion of an alternate detector. Rigid support member 8 extends from the base 5. The base houses the transducer speaker 18, circuitry 11, batteries 12 in the battery compartment 6, indicator 9, alarm test/cancel button 10 and drop flag or ribbon 41.

Figure 5:
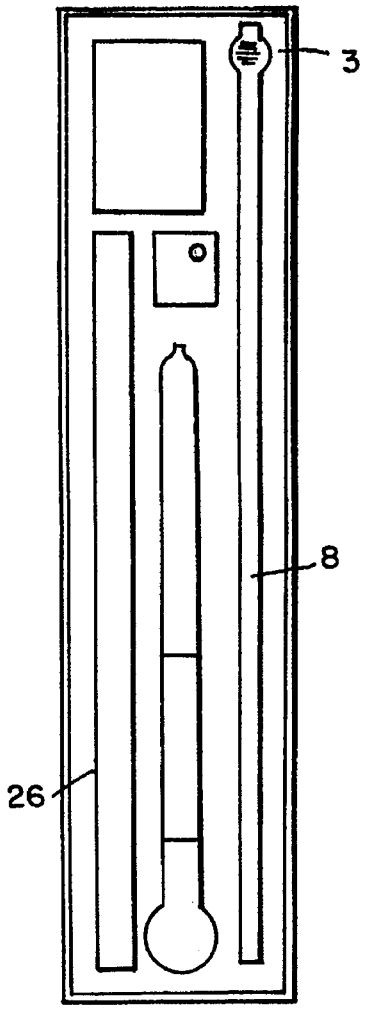
FIG. 5 shows a package of the entire detector with a wall mounting plate, a base unit and a rigid support member with the sensor.

FIG. 5 shows the packaging of the whole detector shown in FIG. 4 before assembly. An elongated mounting plate 26 which is to be mounted on a wall is provided. The rigid support 8 with the sensor 3 can be attached to the detector base 5 before mounting the whole housing in the mounting plate 26. The mounting plate 26 can be mounted to the wall by any known means such as by screws or adhesives or the like. The housing is mounted to the plate 26 by sliding, snap-fit or any known means.

The sensor unit and rigid support 8 are connected with the signal processing base 5 by any connection means such as a telescoping snap-fit. In snap-fit modules the possibility of incorrect or incomplete attachments is precluded by the required alignment of detents. The connection can be effected by fixing the support member within the base, and releasing can be effected by pressing two lateral opposed buttons simultaneously, on either side of the housing, or some other appropriate means.

In snap-fit modules the electrical connections between the modules may be effected by using plated contacts molded into the plastic housings of each module (sensor and base). The modules would be molded such that the molded contacts provide positive contact pressure when the mating modules are assembled. Some other means may be used to provide similar functionality for assembly and electrical connection to include conventional wiring with solder connections or any other known means.

Preferably, the size of the main body component is about 24 inches from the upper end that attaches the sensor component to the lower end which effects a connection to the power and radio transmitter within the base. The detector is wide enough to accommodate the functional components within the housing as well as the user interface equipment on the housing.

A mounting plate 26 is provided with the detector. The plate provides secure mounting on the wall. Mounting can be effected by screws affixed on wooden or drywall surfaces. After mounting of the plate the detector is inserted in the plate such that it can be easily removed and is suspended securely. Preferably, the base is mounted on the plate to give easy user access.

Preferably, the mounting height of the mounting plate is within easy reach, for example about 4 feet to 6 feet above the floor which covers the 5th–95th percentile of adults. The mounting plate may also be adhesively attached to the wall instead of with screws. Other means of attachment are also within the scope of this invention.

The detector can be easily removed from the plate for periodic cleaning and maintenance.

FIG. 6 describes a preferred detector 1 with the speaker 18, indicator 19, control buttons 21 and 22, and opposed mounting release buttons 23 and 24. Sensor 3 is mounted at the top of rigid mast support 8. A removable battery compartment cover 25 is provided to enable the user to change batteries easily, since it is at user height and easily accessible.

The detector 1 has a positioning probe 20 that is attached to the housing. Probe 20 is extended from the housing to position the sensor spaced from the ceiling, so that the sensor is not located in the "dead zone" within about 6 inches of the ceiling where smoke is not likely to accumulate. The sensor portion may be angled from the generally vertical elongated housing to allow the sensor to be mounted spaced from the vertical wall, thereby enhancing the sensing of any smoke or fire in residences.

Figure 7:
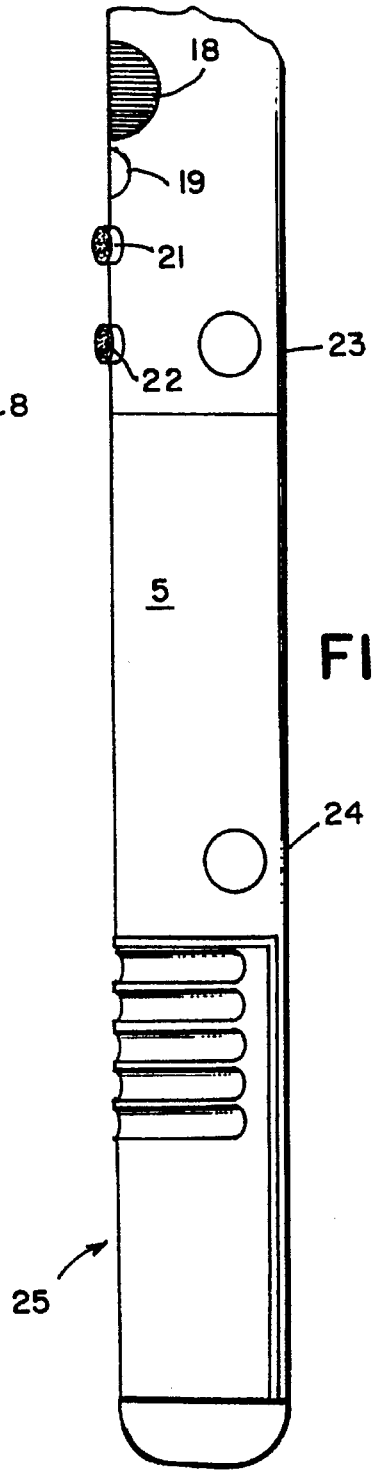
FIG. 7 shows the base unit of the detector shown in FIG. 6 with the control buttons, the battery compartment and optional radio frequency transmitter module.

FIG. 7 gives details of the control buttons 21 and 22, which are on the surface of the base. The speaker 18 is mounted within the housing as shown. Indicators, such as LED indicator 19, are provided on the housing. An alarm cancel button 21 is provided to cancel an alarm. Test commands are initiated by test button 22. The test button is used for testing the sensor functionality and audio and visual alarms within the detector system. The buttons are provided with visual indicators such as written labels and/or color coding identifying their purposes. The buttons are also provided with tactile indicators, such as braille or other indicators to enable users relying on tactile perceptions to differentiate between the different buttons and their purposes.

Button 23 is one of two lateral opposed buttons that can be depressed to release the support member from the base, when the two are pressed or snap-fit with each other for this embodiment.

Release button 24 facilitates the release of the battery compartment 25 to enable users to change batteries easily. Compartment 25 can be press fit to engage with the housing and the button 24. The battery compartment cover is provided with means to prevent closing when the batteries are not installed. For example, flexible ears placed on the battery compartment are spread out to insert the batteries.

Figure 8:
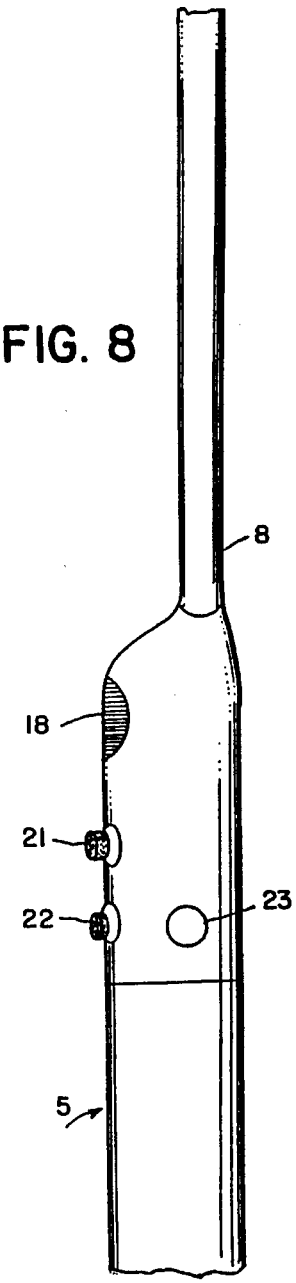
FIG. 8 partially shows the rigid member extending from the base unit of the housing.

Rigid member 8 shown in FIG. 8 can be made of any material and is shown extending from the base 5 above the speaker 18 mounted on the base.

Figure 10:
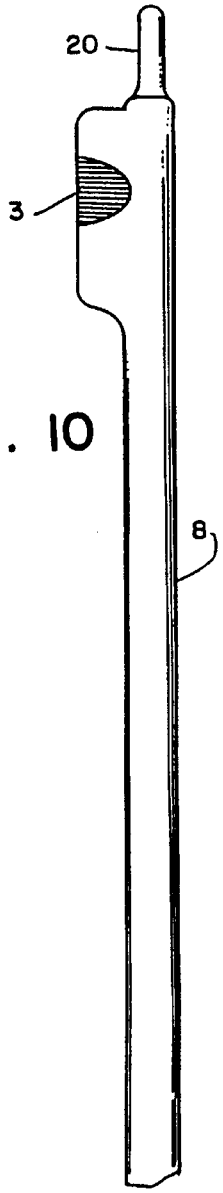
FIG. 10 shows the rigid supporting member, the sensor and the positioning probe before extension.
Figure 9:
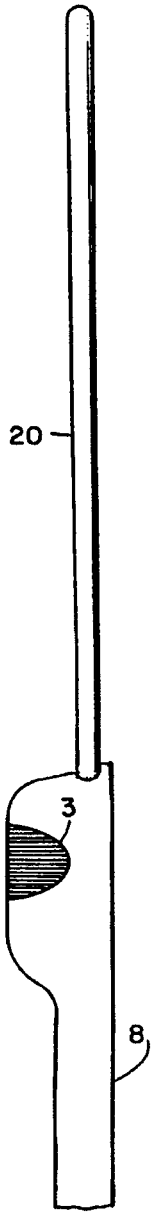
FIG. 9 shows the sensor unit and the extended positioning probe of the detector shown in FIG. 6.

The positioning probe 20 shown in FIGS. 9 and 10 is fitted at an upper end of the housing above the sensor 3. This probe may operate telescopically as in the current embodiment. The positioning probe enables the user to measure a desired distance from the ceiling before installing the detector on the wall. The probe ensures that the sensor is mounted spaced from the ceiling. A preferred distance is at least 6 inches from the ceiling. Preferably, the detector measures about 2–4 feet from end to end.

Figure 11:
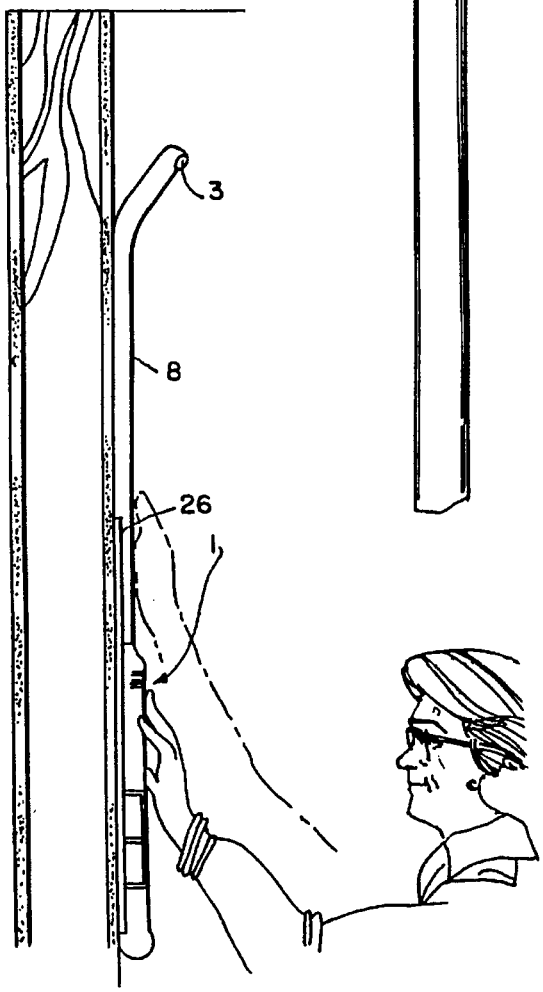
FIG. 11 shows a user mounting a detector on a wall with the controls at user eye level.

FIG. 11 shows the user easily installing the detector on a wall 2. As can be seen, the base 5 is easily accessible and controls on the base are conveniently located at user eye levels.

Figure 12:
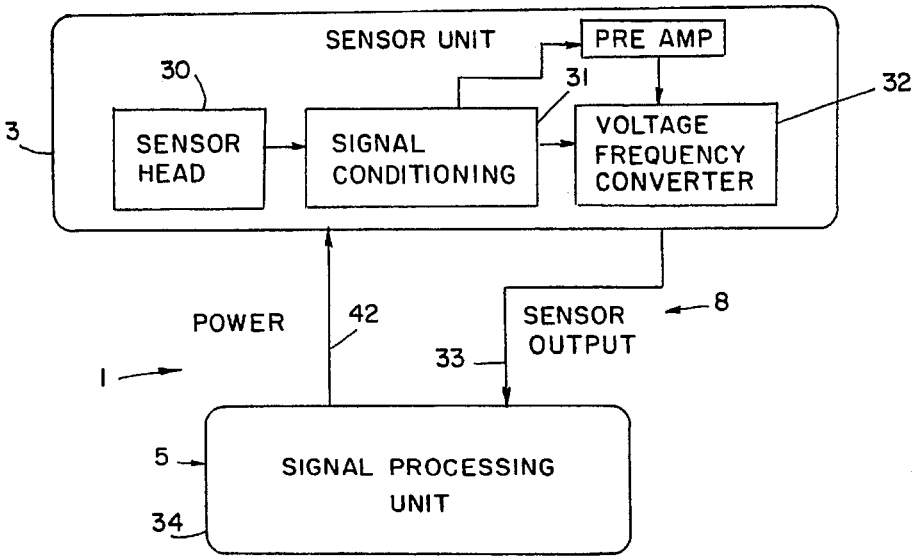
FIG. 12 is a block diagram of the sensor unit electronics with respect to the signal processing unit.
Figure 13:
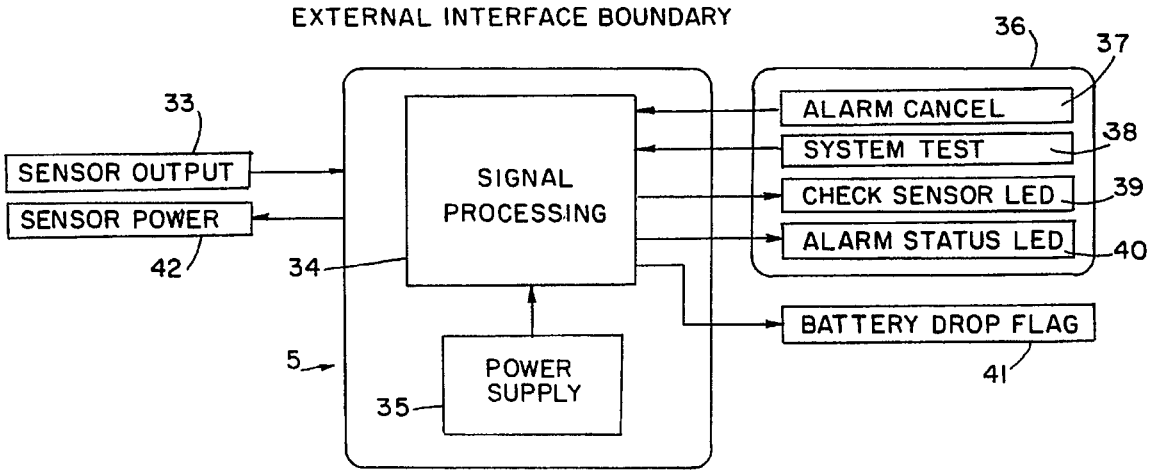
FIG. 13 depicts system inputs and outputs to and from the signal processor.
Figure 14:
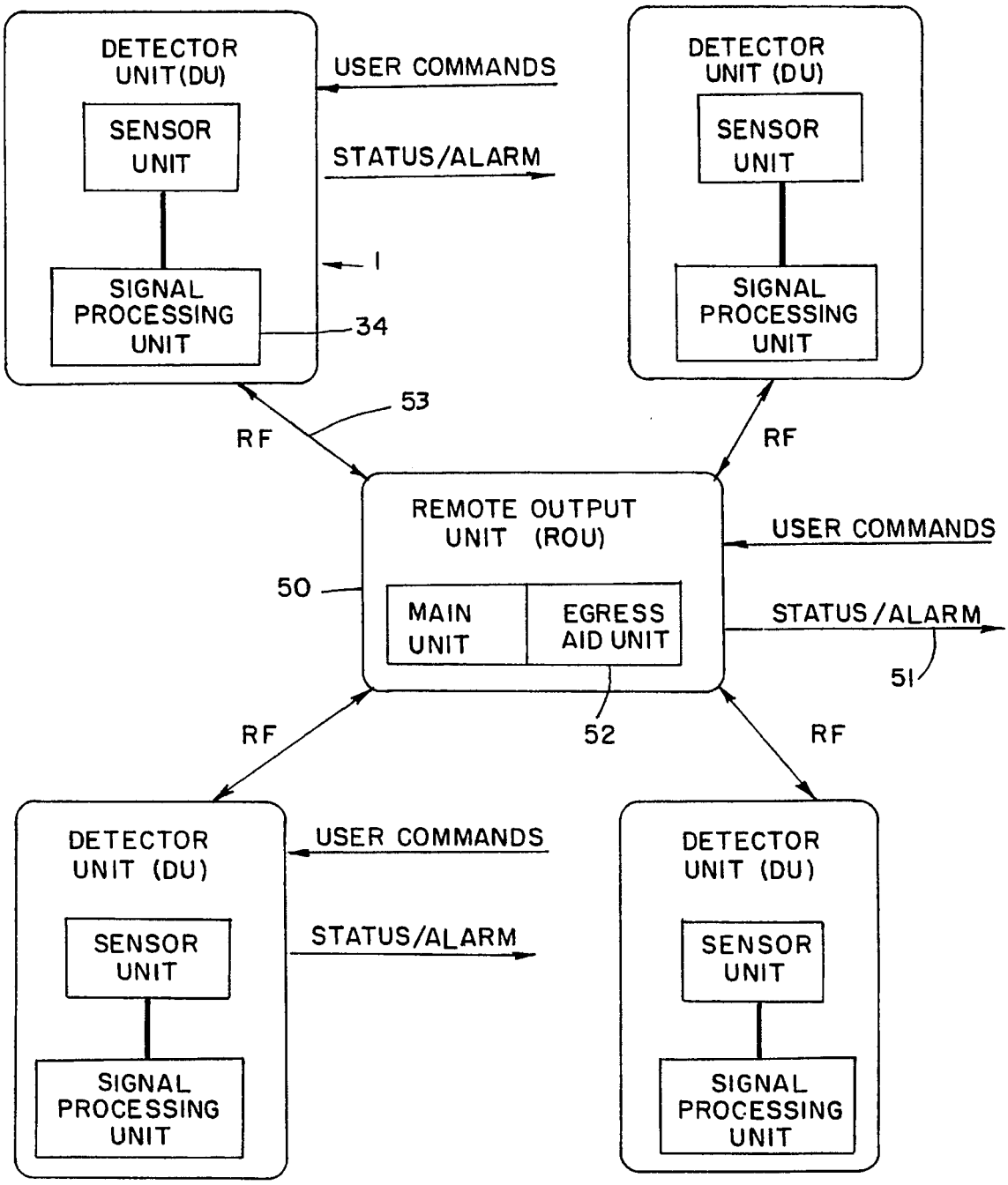
FIG. 14 shows the communication details between the detector units and the remote output unit.
Figure 16:
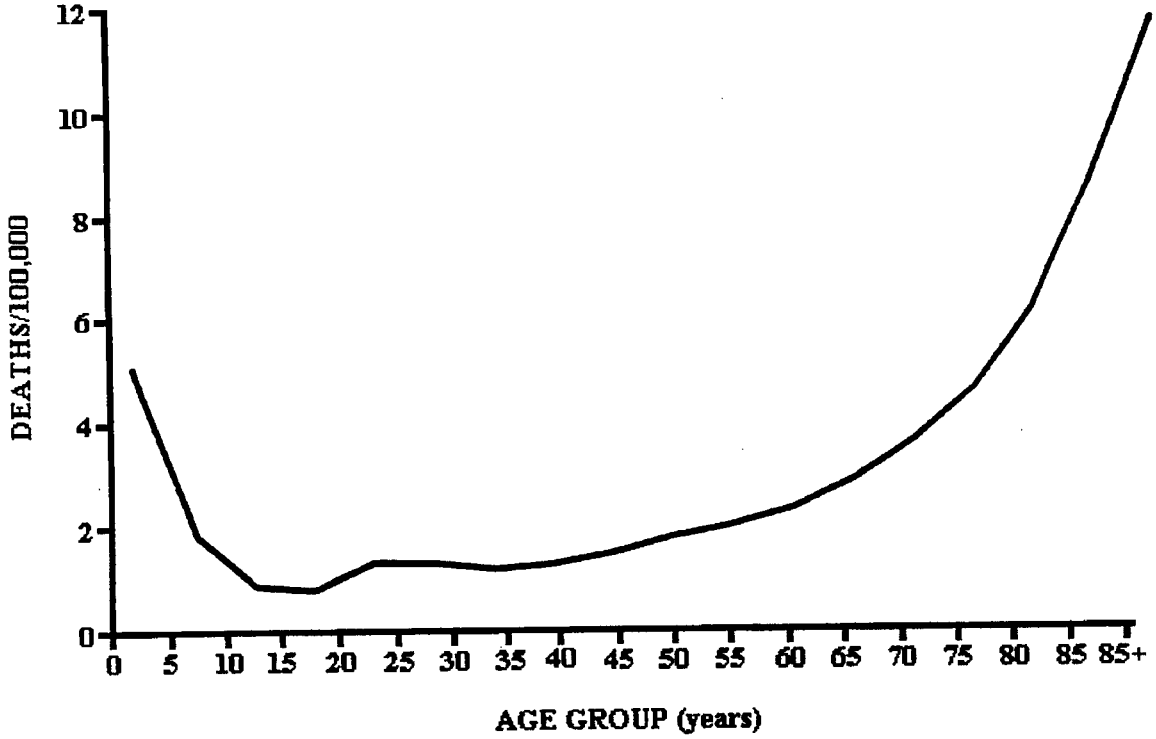
FIG. 16 is a graph to indicate death rates from residential fires versus ages.

FIGS. 12, 13 and 14 show the details of the communication network operating the internal systems within the housing which includes the sensors and processors.

As shown in FIG. 12, the detector 1 contains all functions to test, to detect and to annunciate alarm signals. The detector unit mainly comprises the base 5, the sensor 3 and a rigid interconnecting mast 8. The sensor encloses a smoke sensor head 30, a signal conditioner 31, a pre-amplifier 44, a voltage-to-frequency converter 32 and transmission components necessary to transmit information of the sensor output 33 to the base 5.

As shown in FIG. 13, the base 5 forming the lower section of the detector houses all signal processing electronic circuitry 34, power supply 35 such as batteries, and the user interface equipment 36 as described above. The circuitry analyzes the sensor output 33 received from the sensor as well as alarm cancel 37 and system test 38 inputs received from the user interface equipment 36. The system provides an audio alarm such as an alarm horn. System status indicators 39 and 40 may be audio or visual indicators. System outputs will comply with relevant standards for such alarms dictated by UL and NFPA. Drop flag or ribbon 41 indicates low or no power condition. Sensor power is supplied to the sensor through line 42.

Preferably, the smoke sensor of the present invention is a photoelectric unit. It may also be a thermosensitive heat detector unit. The photoelectric sensor comprises a Photodiode detector and an Infrared Emitting Diode (IRED) and complies with the standards required for such sensors. A heat sensor can be used along with or in place of the photodiode sensors, especially in areas prone to constant smoke such as kitchens and garages.

The sensor uses a voltage-to-frequency converter to implement an Analog to Digital converter. The output of the frequency converter is analogous to the smoke obscuration at the photodiode. That signal is transmitted between the sensor and the base by hardware connection effected through the rigid member 8 shown in the drawings. Power supply for the sensor unit is drawn from the signal processing unit within the base.

The signal processing unit (SPU) in the base contains electronics needed for analyzing the signal outputs received from the sensor as well as those received from the user interface. The user input controls include manual testing and output cancellation that are activated by the buttons on the housing at the user interface.

Also included is the logic and circuitry for providing optimal output tailored for user needs. It preferably includes a base-to-alarm threshold that shifts to accommodate changes in sensitivity caused by age or foreign matter accumulation. This threshold adjustment can be a function of rise time and magnitude of change in particulate density.

When the manual testing button is pressed, the SPU indicates the operational status of the sensor. The status LED and audible alarm on the base are activated to indicate the status and an appropriate message is also transmitted to the ROU it the RF communication module is in place.

The SPU of the present invention is provided with an automatic periodic self-testing capability to ensure proper operation of the sensor, the signal processing unit and the communication features of the detector system. This status is reflected by the status LED on the housing. The LED is pulsed to reflect a positive system status. When the system status is unsatisfactory the LED indicator ceases pulsing until conditions are restored. Preferably, an audible tonal output is also activated.

When the detector 1 is communicating with a remote output unit, as shown in FIG. 14, the status check report is transmitted to the remote output unit 50.

When smoke is detected, the status LED turns on continuously until the condition is corrected or until the alarm cancellation button is activated. The LED has low power consumption. If the optional transmitter is installed, a unique identifying code relating to the specific detector 1 is transmitted to the ROU 50.

An audible tone output is pulsed at the local detector 1 which comprises an alarm output. The main spectral component of the audible output is as close to 500 Hz as possible with a minimum sound pressure level of 85 dB at about ten feet. This output is pulsed at about 10 Hz with a 50% duty cycle. The indication is capable of being temporarily overridden by depression of the alarm cancel button 21.

The SPU 34 periodically checks the condition of the sensor for reduced and nonexistent operation. When reduced functionality is detected, appropriate audible and visual output at the DU is activated. If the optional RF transmitter and ROU are being used, appropriate annunciation will also be provided at the ROU.

The SPU also monitors the condition of the power supply. The method of determining the status of the battery or other power supply source conforms with existing requirements. A low power condition at the DU is indicated by deployment of the battery condition drop flag and the emission of an audible alarm to reflect the condition. An audible tonal output with similar characteristics as described earlier is activated. If the condition persists then the audible alarm may cease but the drop flag remains in force to alert the user.

The SPU has means for temporarily cancelling the alarm. Upon a system alarm due to smoke detection, depression of the cancel button quiets the local audible alarm and returns the visible displays to the normal operating modes. Essentially, the button reduces the sensitivity of the sensor for about 10 minutes. After that, the sensor returns to its normal sensitivity level and operational settings. Also, automatic alarm cancellation of the alarm output is provided to cut off the alarm output when there is a reduction of the stimulus concentration for a predefined period of time.

Displays are provided for each of the operational conditions of the DU, including normal function, alarm, low or dead battery and dirty or faulty detector. The DU may include up to two LED's and a drop flag. A status LED is usually red indicating the normal and alarm conditions. A check sensor LED is amber and is used to designate faults in the system. A drop flag is provided to alert the user of low or dead power supply conditions. The flag has an appropriate warning, such as "Recharge Batteries" or the like, written on it.

The audible signal is created within the base of the DU. The sound output is supplied by a piezo transducer or a speaker vibrating at a frequency as close to 500 Hz as technically feasible. The sound may be amplified by an organ pipe-like tube tuned to the resonant frequency.

Modularity is provided within the components of the system. The stand-alone DU is convertible to a networked DU by adding a radio transmitter component.

Preferably, ordinary batteries are the power supply source for the DU. The batteries can be common Nickel Cadmium consumer rechargeable batteries or others. Rechargeable C-cells, D-cells or 9-volt batteries may be used according to the system power needs. The power supply source is preferably located at the lower end of the base unit.

The batteries can be recharged within the remote output units 50, when such is in use, and interchanged between the DU's and the remote output units. This allows the batteries to be exchanged between the constantly recharging remote output units and the DU's, thereby allowing the user to sustain the whole system with a rechargeable power source instead of repeated purchasing of single-use batteries.

The remote output unit (ROU) 50 is portable and includes all functions for displaying the status of each DU communicating with the ROU. The ROU has audible and visible alarm outputs 51 and annunciation. The ROU also has a removable egress aid 52, such as a flashlight, which can be removed quickly and can be used to navigate through dark and smoke-filled areas to a safe exit. The detectors preferably communicate with the remote unit via radio frequency 53. The ROU can be carried around so that the user can have access to it at all times. The ROU is activated by the signals received from the DU's.

Optional transmitters may be provided on the bases of the DU's to communicate with the ROU.

Radio frequency communication is preferably used to pass all the necessary information between the DU's and the ROU. The DU provides all the earlier described status signals to the ROU. The SPU converts the discrete control messages to an analog radio frequency message and transmits it to the ROU. The transmitter operates in a sleep mode when transmission is completed, thereby conserving power. The unit is provided with means to operate within the house and to avoid interferences in adjacent houses.

The transmitter may be inserted between the signal processor and the power supply within the base of the housing. A selector switch may be provided on the back of the transmitter module indicating specific locations of the DU's, for example "upstairs", "main", "basement", etc. The selector switch will uniquely connect that DU with a relevant indicator on the ROU display panel.

The ROU provides redundant alarm output signals received from each DU. It provides unique annunciation related to particular signals received from each DU beyond the redundant alarm output. The output may include a description of the signal, the location of the particular DU sending the signal and the desired reaction. Outputs vary in visual and audible characteristics as well as priority according to signal meanings.

The ROU is capable of detecting and differentiating up to four different DU's and providing outputs relating to each of the DU's in unique individual outputs. The ROU is operable on any power source including household and batteries. Variable parameters including audible and visual output duty cycle, repetition rate, cancellation method, priority with respect to other alarm conditions are provided. The alarms use tonal output, a high intensity strobe light and possible voice for audio and visual output signals. The audible tone intensity may be adjustable by the user between upper and lower limits on the remote unit. Current settings can be tested by an output test function on the ROU. The volume control is provided with visual and tactile identity to help the user differentiate between other controls. The remote unit can be upgraded to provide optional voice annunciation of the situations.

Normal signals received from the DU's are logged into the remote system. However, when trouble signals are received the ROU reflects the trouble signals and needed reaction. The ROU provides alarm indications when smoke signals are received. The ROU also reflects the status condition alarm of each DU and the low power supply conditions until the situation is corrected. It is activated to reflect sensor conditions when the sensitivity of the sensor is affected. The ROU may also be provided with means to reflect the recharging condition, system condition and output testing condition.

ROU's are portable and are made to merely rest on table tops or affixed to the walls by means of screws or the like.

The ROU is provided with a removable egress aid 52, such as a detachable flashlight, which can be removed from the unit in emergencies and used as visual aid to maneuver around darkened and smoke-filled rooms to a safe exit. Power is received from the rechargeable batteries housed in the case forming the egress aid. The flashlight has a high intensity strobe light. A charge indicator is located on the front of the removable egress aid case to reflect a fully charged condition of the removable egress aid.

FIGS. 15*a*, 15*b*, 15*c* and 15*d* show the universal accessibility and ease of installation, operation and maintenance of the present detector. FIG. 15*a* shows a person cleaning the parts of a detector 1. FIG. 15*b* shows a detector mounted on a wall. FIGS. 15*c* and 15*d* show persons pressing buttons to test the detector.

While the invention has been described with reference to specific embodiments, modifications and variations of the invention may be constructed without departing from the scope of the invention, which is defined in the following claims.

We claim:

1. Smoke detector apparatus comprising a detector with an elongated housing, the housing having first and second ends, the first end forming a base for mounting on a wall of a room and the second end housing a sensor for positioning below a ceiling of the room, remote from the base, a rigid member supporting the sensor within the housing and connecting the sensor to the base within the room, a signal processor placed within the base and connected to the sensor for processing signals transmitted from the sensor, a display on the base for displaying conditions of the detector, wherein the first end of the elongated housing is wall mountable within easy reach without climbing, and display, controls and maintenance functions are at user eye level, further wherein the sensor comprises a smoke sensor, a signal conditioner connected to the smoke sensor, and a preamplifier connected to the smoke sensor, for respectively detecting smoke, conditioning, preamplifying and communicating signals from the sensor to the signal processor in the base, further comprising a power supply mounted in the base and connected to the signal processor and to the sensor, further comprising a drop flag attached to the housing for persistently indicating reduced status of the power supply, and audible and visual output means on the housing for providing system status and alarm indications in response to signals received from the signal processor.

2. A smoke detector and alarm apparatus comprising an elongated housing, the housing having a first end forming a base for mounting on a wall of a room and a second end forming a sensor for positioning below a ceiling of the room remote from the base and a rigid member supporting the sensor within the housing and connecting the sensor to the base, wherein the first end of the elongated housing is wall mountable within easy reach without climbing, and display, controls and maintenance functions are at user eye level, further comprising a remote output unit for processing signals received from the detector via radio frequency data link and for providing audible and visual alarm outputs.

3. The apparatus of claim 2, further comprising a removable egress aid (i.e., dedicated flashlight) connected to the remote output unit for removing from the remote output unit and for using to navigate an emergency egress.

4. A smoke detector and alarm apparatus comprising an elongated housing, the housing having a first end forming a base for mounting on a wall of a room and a second end forming a sensor for positioning below a ceiling of the room remote from the base and a rigid member supporting the sensor within the housing and connecting the sensor to the base, wherein the first end of the elongated housing is wall mountable within easy reach without climbing, and display, controls and maintenance functions are at user eye level, further comprising a signal processor placed within the base and connected to the sensor for processing signals transmitted from the sensor, and controls and displays on the base for interacting with and displaying output of the signal processor, further comprising a power supply in the base connected to the signal processor, and audible and visual alarms connected to the signal processor and user interactive controls connected to the signal processor, further comprising a drop flag attached to the housing for persistently indicating reduced status of the power supply within the detector, and audible visual output means on the housing and connected to the signal processor for translating signals from the signal processor to audible and visual alarm outputs.

5. Smoke detector apparatus for detecting smoke comprising:

a rigid elongated member having upper and lower ends;

a mounting base connected to the lower end for mounting the lower end of the elongated member at user eye level on a wall of a room within easy reach, without climbing;

a smoke detecting sensor connected to the upper end for positioning below a ceiling of the room and away from a mounting wall.

6. The apparatus of claim 5, further comprising a positioning probe connected to the upper end for positioning the upper end spaced from a ceiling.

7. The apparatus of claim 5, wherein the upper end is removably attached to the lower end.

8. The apparatus of claim 5, further comprising a first button attached to the base for cancelling an alarm, said first button having first visual and tactile indicators.

9. The apparatus of claim 8, further comprising a second button attached to the base for testing the detector functionality, said second button having second visual and tactile indicators distinct from the first visual and tactile indicators.

10. The apparatus of claim 5, further comprising a mounting plate for mounting on a wall within easy reach and for receiving and holding the mounting base of the detector on the wall.

11. The apparatus of claim 5, wherein the elongated member is releasably connected to the base by snap-fitting or some other attachment means, and further comprising a release means for releasing sections of the base from the mounting plate.

* * * * *